US009805631B2

(12) United States Patent
Howell

(10) Patent No.: US 9,805,631 B2
(45) Date of Patent: Oct. 31, 2017

(54) PORTABLE DISPLAY BOARD

(71) Applicant: Darren B. Howell, Van Nuys, CA (US)

(72) Inventor: Darren B. Howell, Van Nuys, CA (US)

( * ) Notice: Subject to any disclaimer, the term of this patent is extended or adjusted under 35 U.S.C. 154(b) by 0 days.

(21) Appl. No.: 14/936,280

(22) Filed: Nov. 9, 2015

(65) Prior Publication Data

US 2016/0275832 A1 Sep. 22, 2016

Related U.S. Application Data

(63) Continuation-in-part of application No. 29/521,191, filed on Mar. 20, 2015.

(51) Int. Cl.
*G09F 15/00* (2006.01)
*G09F 7/04* (2006.01)

(52) U.S. Cl.
CPC ..... *G09F 15/0068* (2013.01); *G09F 15/0062* (2013.01); *G09F 7/04* (2013.01)

(58) Field of Classification Search
CPC ..... G09F 7/04
USPC ..... 40/600, 606.15, 606.16, 611.02, 611.01
See application file for complete search history.

(56) References Cited

U.S. PATENT DOCUMENTS 1,406,926 A * 2/1922 Bryan ..... G01F 23/02 73/326
1,953,756 A * 4/1934 Hennessey ..... G09F 21/04 248/302
2,090,157 A * 8/1937 Smith ..... B60Q 7/005 248/188.1
2,515,818 A * 7/1950 Bennett ..... G09F 7/00 40/607.06
4,800,947 A * 1/1989 Loomis ..... G09F 15/0025 160/368.1
7,441,358 B1 * 10/2008 Ngan ..... G09F 1/10 281/33
2002/0078612 A1 * 6/2002 Meacham ..... G09F 7/04 40/711
2004/0006902 A1 * 1/2004 Zarelius ..... G09F 15/00 40/600
2006/0225331 A1 * 10/2006 Evans ..... G09F 1/10 40/600
2009/0183408 A1 * 7/2009 Dicke ..... G09F 15/0037 40/610
2009/0293331 A1 * 12/2009 Kemeny ..... G09F 15/0025 40/610
2013/0269228 A1 * 10/2013 Larsen ..... G09F 7/04 40/584

(Continued)

*Primary Examiner* — Kristina N Junge
(74) *Attorney, Agent, or Firm* — Sean D. Burdick

(57) ABSTRACT

A portable display board comprises a generally rectangular sheet defining a display area bordered by rod mountable edges. Each rod mountable edge comprises a duct configured for passage of a mounting rod therethrough. The generally rectangular sheet has one or more slanted corners each horizontally and vertically displacing a horizontal duct from an open top or bottom end of a vertical duct to allow passage of the rod along a longitudinal axis of the horizontal duct without interference from the vertical duct and vice versa. The sheet may be formed from magnetic material and the portable display board can be suspended by a duct from a C-stand for display of magnet-backed scenes for storyboarding or other purposes.

13 Claims, 11 Drawing Sheets

(56) References Cited

U.S. PATENT DOCUMENTS

2014/0347724 A1* 11/2014 Schultz ..... G03B 21/62
359/450

* cited by examiner

PORTABLE DISPLAY BOARD

RELATED APPLICATIONS

This application is a continuation-in-part of U.S. patent application Ser. No. 29/521,101 that was filed on Mar. 19, 2015 and which is fully incorporated herein by reference.

BACKGROUND OF THE INVENTION

Field of the Invention

The present invention relates generally to signage, and more specifically to portable display boards for effecting signage, e.g., for advertising or storyboarding.

Description of Related Art

Portable display boards are typically mechanical constructs that include a planar material that provides a surface for posting or displaying information such as advertising. The planar material may be made from wood, plastic, metal, cardboard, or paper. In addition, the portable display board my include a feature or an attachment such as a hanger for mounting the board to a wall, a stake for supporting the board in a standing position, or a handle to allow a user to hold or raise the board by hand. Some common uses for portable display boards include advertising real estate for sale or lease, advertising food for sale on a street corner, providing temporary signage for directing traffic at conventions or on roadways, and providing story boards, e.g., when filming in studio or on location. Due to their relative simplicity, portable display boards have not been a focus of innovation for many years.

The problem being solved by the present invention arises particularly in the filming or motion picture industry, where the use of display boards as storyboards has been common practice since the Walt Disney Animation Studio began perfecting their usage in the 1930s. Storyboards used in the filming industry are typically cardboard or foam boards that provide a backing for attaching in sequence a series of sketches or graphic illustrations that each represent a scene to be filmed, with the overall result being a visual layout of the story not unlike the frames of a comic book. Each such scene is usually produced on a sheet of paper and attached to the storyboard by pinning, taping or pasting with an adhesive. During the creative course of filmmaking, the storyboard reflects a work in progress as scenes are inevitably added, removed, revised, resketched, reordered, and replaced. Removal and replacement of the scenes tends to damage both the backing material and the scenes themselves. Creation, revision, and maintenance of the storyboard can be a very time-consuming commitment.

The utility of the storyboard lies in its simplicity, in its portability, and in its changeability. Cardboard and foam board are lightweight and inexpensive materials and this accounts for their widespread use as backing material for a storyboard or display board; however, such materials are vulnerable to damage and are therefore typically discarded after a very little use. What is needed is a portable display board suitable for use in film and other industries that overcomes the aforementioned disadvantages and adds further efficiency to the storyboarding process.

SUMMARY OF THE INVENTION

The present invention provides an engineered design for a durable and portable display board suitable for use as backing for a storyboard or for other general signage applications. In an exemplary embodiment, a portable display board comprises a first generally rectangular sheet defining a first display area bordered by a first hinged edge and by at least one rod mountable edge. A second generally rectangular sheet of the portable display board defines a second display area bordered by a second hinged edge and by at least one other rod mountable edge. A hinge comprising the first hinged edge and the second hinged edge rotatably connects the first rectangular sheet to the second rectangular sheet. Each of the rod mountable edges comprises a duct configured for passage of a mounting rod therethrough, and each of the sheets is configured to include at least one slanted corner nonadjacent to its hinged edge.

The portable display board may be further characterized by its material composition, for example, the first or second generally rectangular sheets, or both, may be composed of magnetic material to facilitate attachment of magnetic backed signage thereto. In another embodiment, the portable display board may be further characterized by the duct of the at least one rod mountable edge of the first generally rectangular sheet being made into a generally cylindrical form. The generally cylindrical duct may or may not be fully longitudinally enclosed, and may run along substantially an entire length of the rod mountable edge, or may run along a partial length of the rod mountable edge. The portable display board may be further characterized in that the first generally rectangular sheet and the second generally rectangular sheet may be identical in design.

In a more elaborate embodiment of the invention, the portable display board may be configured such that at least one rod mountable edge of the first generally rectangular sheet comprises: a horizontal rod mountable edge comprising a horizontal duct having an open right end and an open left end, and a vertical rod mountable edge comprising a vertical duct having an open top end and an open bottom end, wherein the open top end is adjacent to the open right end or to the open left end, and wherein the open bottom end is adjacent to the first hinged edge. In addition, the portable display board may be configured so that the at least one slanted corner horizontally and vertically displaces the open right end or the open left end of the horizontal duct from the open top end of the vertical duct to allow passage of the rod along a longitudinal axis of the horizontal duct without interference from the vertical duct. Slanted corners are provided at three of the four corners of either generally rectangular sheet, such that either generally rectangular sheet comprises a hexagon having edges consisting of at least four different lengths. In this and other embodiments, the slanted corner may form an angle of approximately 45 degrees with respect to any one of the rod mountable edges.

In another embodiment, one or more of the ducts on the rod mountable edges of the portable display board are formed from the material of the generally rectangular sheets. On a display board made from metal such as sheet steel, the duct may be formed by rolling an edge of the first generally rectangular sheet to form the at least one rod mountable edge of the first generally rectangular sheet. Preferably, where the first generally rectangular sheet comprises first and second rod mountable edges, and wherein the duct for each of the first and second rod mountable edges is formed by rolling an edge of the first generally rectangular sheet, the duct of the first rod mountable edge and the duct of the second rod mountable edge are rolled over the same side of the first generally rectangular sheet. A non-reflective coating such as powder coating may be used to cover the display areas of the board.

In another embodiment of the invention, a portable display board comprises a generally rectangular sheet defining a display area bordered by at least one rod mountable edge, wherein the rod mountable edge comprises a duct configured for passage of a mounting rod therethrough, and wherein the generally rectangular sheet defines at least one slanted corner. The at least one rod mountable edge may comprise a horizontal rod mountable edge and a vertical rod mountable edge, and the horizontal rod mountable edge may comprise a horizontal duct having one or both of an open right end and an open left end. The vertical rod mountable edge may comprise a vertical duct having one or both of an open top end and an open bottom end, and the at least one slanted corner may have a length sufficient to horizontally and vertically displace the open right end or the open left end of the horizontal duct from the open top end or the open bottom end of the vertical duct to allow passage of the mounting rod along a longitudinal axis of the horizontal duct without interference from the vertical duct. Slanted corners may be provided at all four corners of the generally rectangular sheet, such that the generally rectangular sheet comprises an octagon having sides consisting of at least two different lengths. Between the slanted corners, the ducts may be formed from the material of the generally rectangular sheet itself, for example, by rolling an edge of a generally rectangular steel sheet to form the rod mountable edge.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments for a portable display board that is designed according to the invention to overcome disadvantages of conventional display boards as discussed above. The invention has particular utility as a storyboard for the film industry, and also has utility in other general applications for display boards, such as real estate advertising, educational aids, and instructional signage. A display board according to the invention is easy to carry, easy to mount, and allows for easy attachment and removal of visual scenes and signage.

Figure 1:
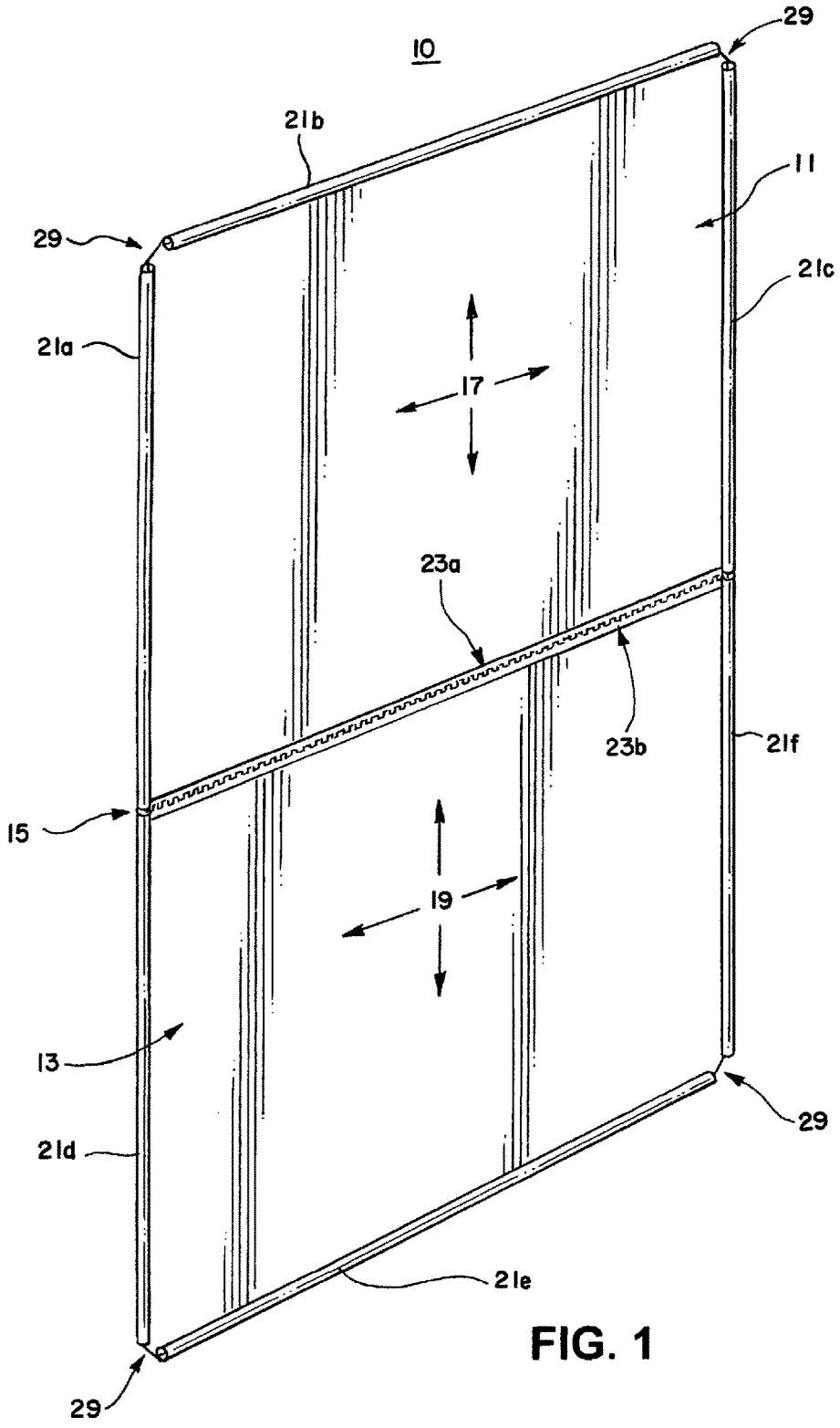
FIG. 1 is a rear perspective view of one embodiment of a hinged portable display board according to the invention shown in a fully open position.

FIG. 1 is a rear perspective view of one embodiment according to the invention of a portable display board 10. Display board 10 is shown first in rear perspective view to better illustrate its characteristic features. Display board 10 includes a first generally rectangular sheet 11 and a second generally rectangular sheet 13 that are joined by a hinge 15. Display board 10 is thus one embodiment of a hinged portable display board. The first generally rectangular sheet 13 defines an upper display area 17 that is bordered by four edges. In this embodiment, the four edges bordering the display area 17 consist of three rod mountable edges 21*a*, 21*b*, and 21*c* and one hinged edge 23*a*. Likewise, the second generally rectangular sheet 13 defines a lower display area 19 that is bordered by four edges, three of which are rod mountable edges 21*d*, 21*e* and 21*f* and one of which is a hinged edge 23*b*.

The first and second rectangular sheets 11 and 13 may be composed of any rigid material, such as wood, metal, plastic, or cardboard, or any combination of these materials. Preferably, one or both of the first and second rectangular sheets 11 and 13 are composed of a sheet metal having magnetic properties, such as a cold rolled carbon sheet steel. In one embodiment, sheets 11 and 13 are formed from steel sheet having rectangular dimensions of 17½ inches by 24 inches, and a thickness gauge in the range of 25 to 30. The invention is, of course, not limited to these exact dimensions. Many other dimensional configurations and tolerances are possible within the scope of the invention.

Hinged edges 23*a* and 23*b* cooperate to form the hinge 15. Each hinged edge 23*a* or 23*b* may comprise a pattern of knuckled leaves suitable for forming a hinge. For example, a series of offset leaves on hinged edge 23*a* may be configured to interleave and align with a complementary series of offset leaves on hinged edge 23*b* to allow a rod or pin 31 to pass through the leaves and thereby engage the hinged edges. So formed, the hinge 15 comprises the first hinged edge 23*a* and the second hinged edge 23*b* and rotatably connects the first generally rectangular sheet 11 to the second generally rectangular sheet 13. The hinge 15 may also comprise other hinge hardware such as the pin 31 that passes through leaves of the hinged edges.

Figure 8:
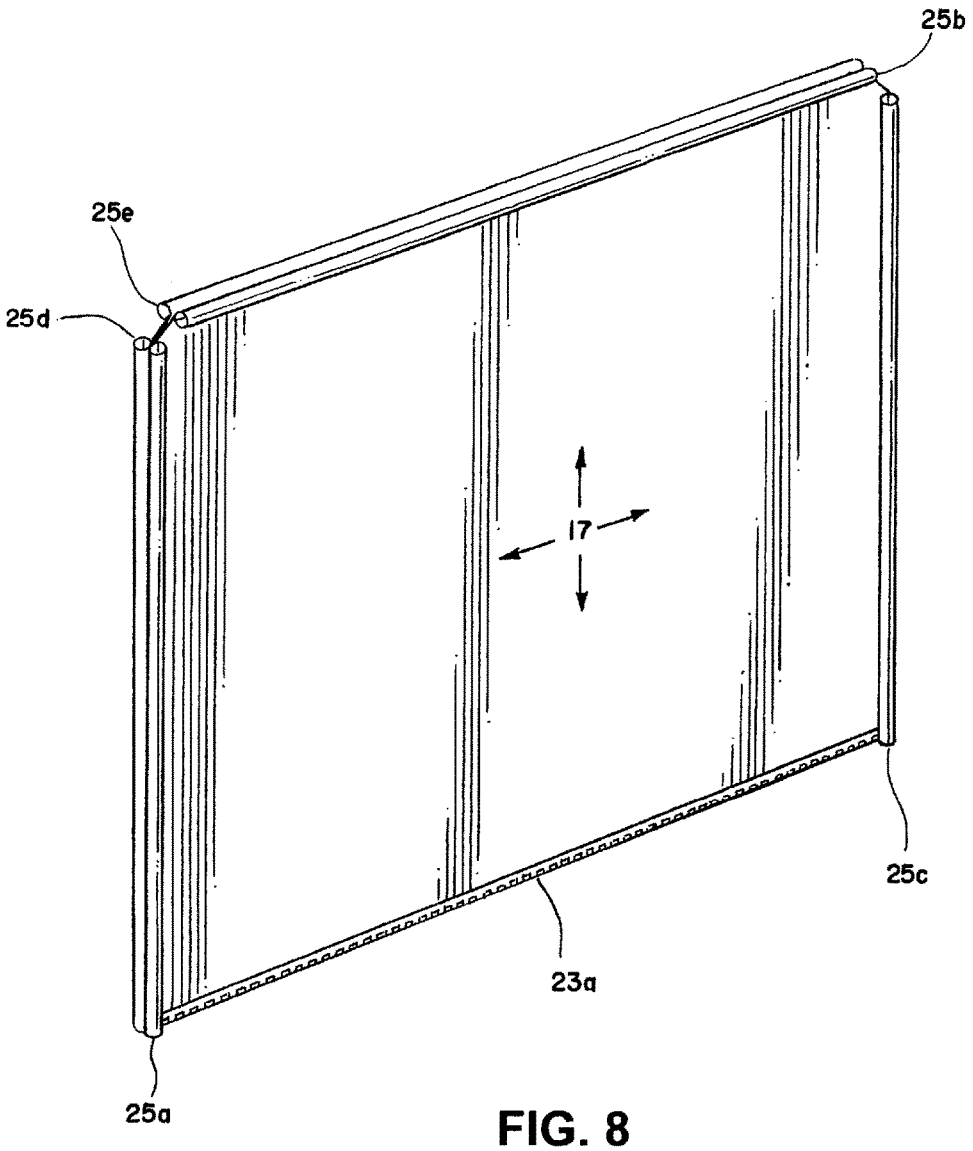
FIG. 8 is a perspective view of the hinged portable display board of FIG. 1 shown in a closed position.

In FIG. 1, display board 10 is shown in a fully open position wherein the first rectangular sheet 11 has been rotated about the axis of hinge 15 until separated by an angle of approximately 180 degrees with respect to the second rectangular sheet 13. The hinge 15 is preferably configured to allow rotation of the first rectangular sheet 11 about the hinge axis from the fully open position to a fully closed position of approximately 0 degrees with respect to the second rectangular sheet 13, in which fully closed position the opposite side of display area 17 (i.e. display area 37) abuts the opposite side of display area 19 (i.e. display area 39). In the fully closed position, as shown in FIG. 8, the display board 10 is more easily ported, e.g. by hand, or it can be conveniently stowed within a carrying case.

Rod mountable edges 21*a*-21*f* each comprise a duct or hollow rail 25 (see FIG. 9) that is configured for accommodating passage of a rod through the entire length of the duct. The duct 25 preferably has a uniform cross-sectional shape, such as circular, triangular, or rectangular. For purposes of illustration only, the ducts shown throughout the various figures of this disclosure are generally cylindrical, having a generally circular cross section. In one embodiment, the inside diameter of the duct 25 is about ⅝ inches. Other sizes for the duct are possible within the scope of the invention. In one application, however, the dimensions of the duct 25 will accommodate the mounting rod, or arm, of a typical century stand (or "C-stand") such as those made by Matthews Studio Equipment, Inc. of Burbank, Calif.

Figure 2:
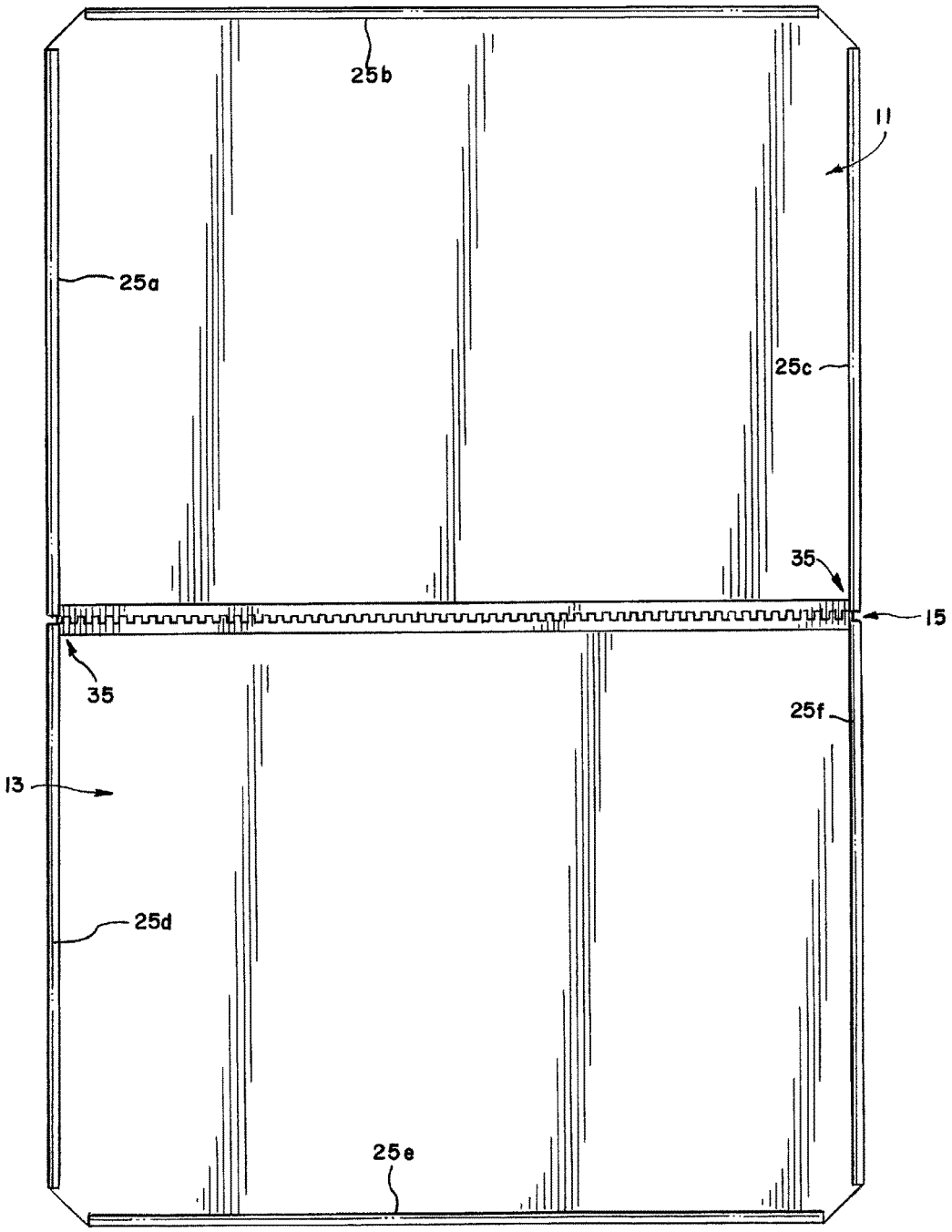
FIG. 2 is a rear view of the hinged portable display board of FIG. 1.

As shown in FIG. 2, each duct 25 (i.e. 25*a*, 25*b*, 25*c*, 25*d*, 25*e* or 25*f*) forms a rod mountable edge at the perimeter of the display board 10. For a display board 10 formed from metal such as sheet steel, the duct 25 is preferably formed on each rod mountable edge using a jig specially designed to bend and roll the edge of the metal sheet. Such metal-bending apparatus are well known in the art and will not be described further herein. An inventive feature of the present invention, however, allows each of the rod mountable edges to be rolled such that no rod mountable edge interferes with the rolling or formation of an adjacent rod mountable edge. That feature is the slanted corner 29 provided on each corner of a generally rectangular sheet 11 or 13 that is nonadjacent to a hinged edge 23*a* or 23*b*, as shown in FIG. 1. The slanted corner 29 may be formed in any corner of a generally rectangular sheet, for example, using a saw or other cutting instrument.

In the embodiment depicted in FIG. 1, each slanted corner 29 joins a horizontal rod mountable edge to a vertical rod mountable edge. For example, on generally rectangular sheet 11, a first slanted corner 29 joins the top end of vertical rod mountable edge 21*a* to the left end of horizontal rod mountable edge 21*b*. Also, a second slanted corner 29 joins the right end of horizontal rod mountable edge 21*b* to the top end of vertical rod mountable edge 21*c*. On generally rectangular sheet 13, third and fourth slanted corners 29 similarly occur at the junctions of the vertical rod mountable edges 21*d* and 21*f* with the horizontal rod mountable edge 21*e*. At each of these junctions, the slanted corner 29 displaces, both horizontally and vertically, a horizontal duct 25 from an adjacent vertical duct 25. This two-dimensional displacement allows the metal-bending apparatus to access and roll any edge of sheet 11 or 13 during manufacture of the display board 10, such that no duct 25 formed by rolling an edge interferes with any adjacent duct 25 that was similarly formed by rolling an adjacent edge. A duct 25 so formed by rolling an edge of the sheet 11 or 13 converts that edge into a rod mountable edge.

Figure 9:
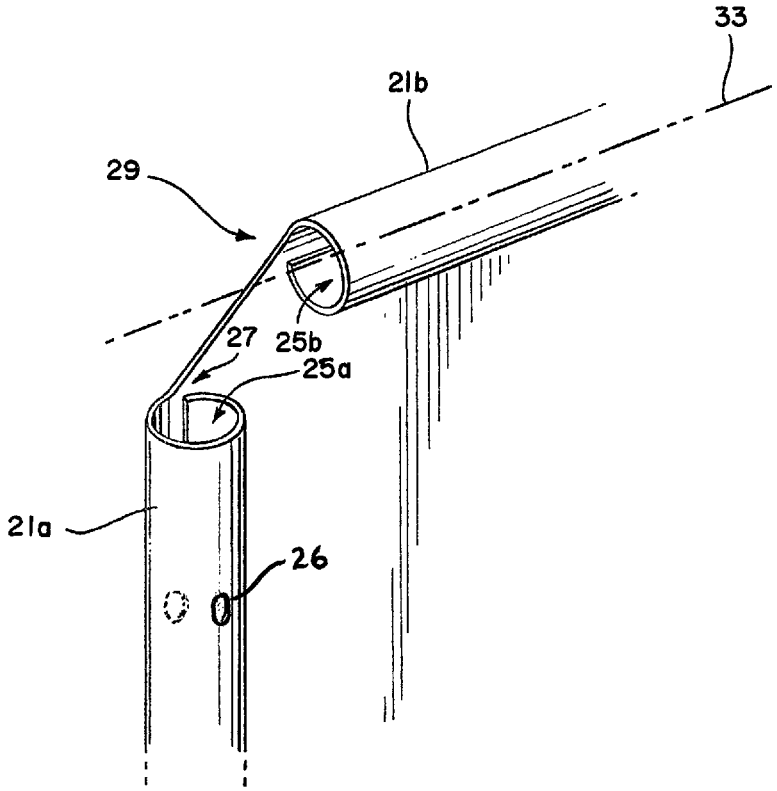
FIG. 9 is a magnified perspective view of a slanted corner of a portable display board according to the invention, showing how a slanted corner of sufficient length displaces, horizontally and vertically, an open end of a horizontal duct from an open end of a vertical duct to allow passage of a rod along an axis of the horizontal duct without interference from the vertical duct and vice versa.

When manufacture of the rod mountable edges is completed, as shown throughout the figures, each slanted corner 29 both horizontally and vertically displaces an open end of a vertical duct 25 from an open end of a horizontal duct 25. For example, the magnified view in FIG. 9 shows the slanted corner 29 horizontally and vertically displacing the open left end of horizontal duct 25*b* from the open top end of vertical duct 25*a*.

FIG. 2 shows a rear view of the hinged portable display board 10 in the fully open position. Vertical and horizontal displacement of the ducts 25 by the slanted corners 29 is evident in this figure. As shown therein, on the generally rectangular sheet 11 a second slanted corner 29 horizontally and vertically displaces the open right end of horizontal duct 25*b* from the open top end of vertical duct 25*c*. The same configuration is shown on the generally rectangular sheet 13, though rotated 180 degrees, such that the third and fourth slanted corners 29 each horizontally and vertically displace the open left or right end of horizontal duct 25*e* from the open bottom end of, respectively, vertical duct 25*d* or vertical duct 25*f*.

In one example of a display board according to the invention, the duct 25 of at least one rod mountable edge (21*a*, 21*b*, or 21*c*) of the first generally rectangular sheet 11 runs along substantially an entire length of the rod mountable edge, as shown throughout the figures. This configuration advantageously maximizes the surface area of the inner diameter of the duct 25 available for supporting the hanging weight of the display board. In other embodiments, such as shown in FIG. 1, the duct 25 of more than one rod mountable edge (21*a*-21*f*) of one or more of the generally rectangular sheets 11 and 13 runs substantially along an entire length of the rod mountable edge. In other embodiments, one or more ducts 25 may run less than the entire length of a rod mountable edge.

Whether a duct 25 runs the entire length of a rod mountable edge or a partial length of a rod mountable edge, the horizontal and vertical displacement of adjacent ducts 25 by slanted corner 29 ensures that a mounting rod may pass through the horizontal duct (or along a longitudinal axis that passes through the center of the horizontal duct) without interference from the vertical duct and vice versa. Thus, according to the invention, a portable display board may be suspended from a horizontally oriented mounting rod that runs through any of the ducts. See FIGS. 11 and 12.

The duct 25 may be fully longitudinally enclosed, as illustrated in FIGS. 4-7, or it may be partially longitudinally enclosed, as illustrated in FIG. 9. When the duct 25 is only partially longitudinally enclosed, a gap 27 extends longitudinally between open ends of the duct to displace the edge of the duct a short distance from the surface of the board at the display area 17 or 19. The partially enclosed configuration allows the duct to flex slightly to facilitate passing a rod through the duct, or to accommodate larger sized rods when necessary. When the duct 25 is fully longitudinally enclosed, no such gap exists, in which case the edge of the duct contacts the surface of the display board. In the fully longitudinally enclosed configuration, the edge of the duct may be fixed to the display board, for example, by welding, to provide better support for the duct and protect the rod mountable edge from excessive bending and other incidental damage that may occur over the service life of the display board.

The display board 10 may be coated in any of various ways known in the art, such as by spray painting. In one embodiment, a powder coating paint technique may be employed, using known methods similar to those used for finishing metal chassis, wheel rims, and other automobile parts. Preferably the coating may be applied uniformly over all surfaces of the display board to inhibit rust. In other embodiments, the coating may be applied only to a portion of the display board. For example, in one embodiment only the display areas of each rectangular sheet are coated. In another embodiment, only one side of each rectangular sheet 11 and 13 may be coated. The color of the coating may be functional, and chosen to suit an intended purpose. For example, a display board 10 used as an advertising sign may be coated with a bright eye-catching color; whereas a display board 10 used for storyboarding in a film studio may be coated flat black to prevent undesirable reflection of studio lighting.

Figure 3:
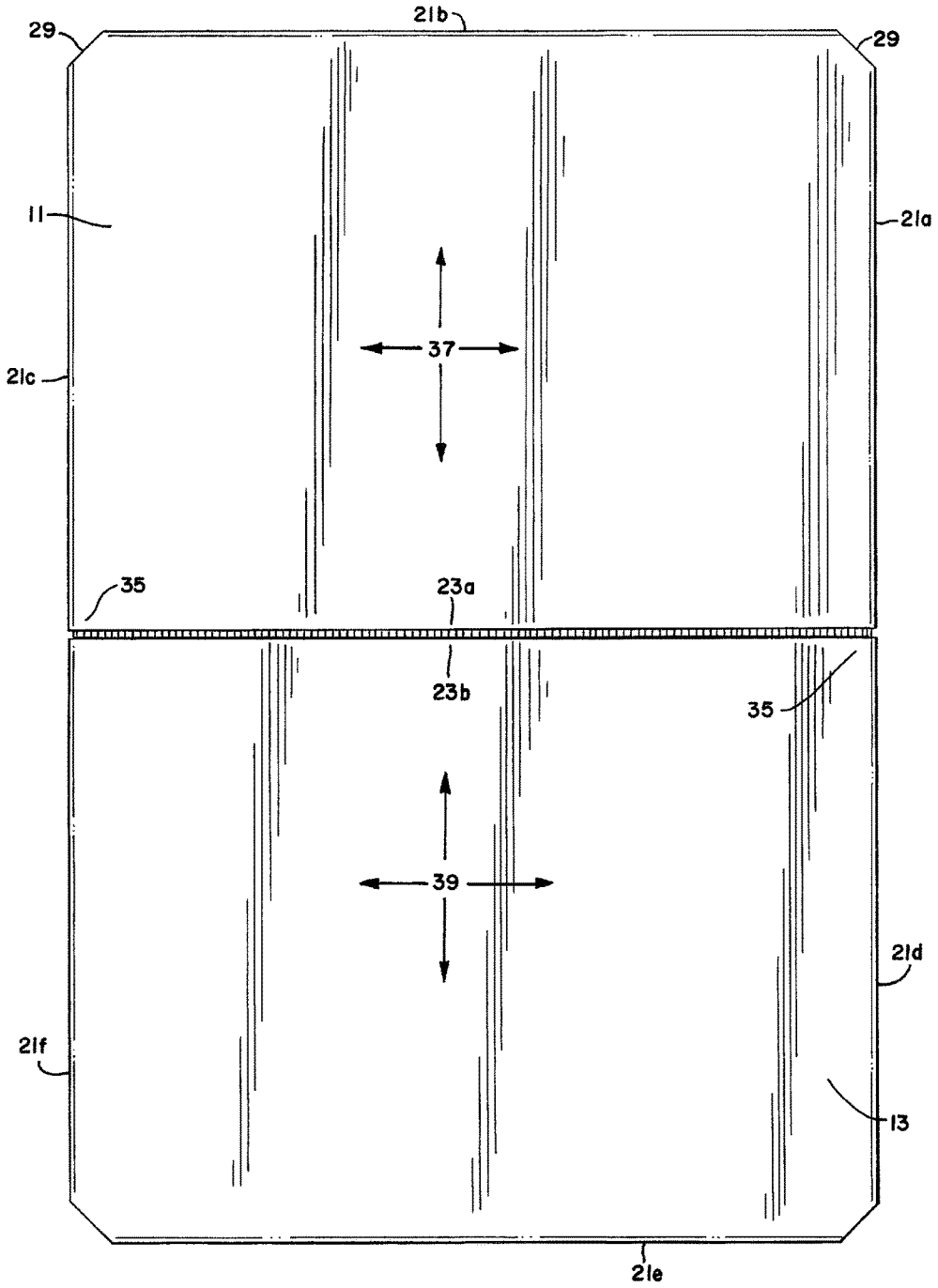
FIG. 3 is a frontal view of the hinged portable display board of FIG. 1.

FIG. 3 shows a frontal view of the hinged portable display board 10 in the fully open position. Viewed from this perspective, the ducts 25 are hidden behind the upper display area 37 and lower display area 39. In a preferred embodiment in which display board 10 is composed of a coated magnetic material, display areas 37 and 39 provide spacious smooth surfaces suitable for holding signage affixed with magnetic backing. For example, paper or cardboard signage or story board scenes may be enclosed in transparent plastic envelopes that have magnetic strips attached. Such envelopes or signage may then be easily positioned at any desired location on display area 37 or 39, as the magnetic strips attach to the magnetic surface of the display board. Story board scenes or signage may thus be easily repositioned, rearranged, or removed, without damaging the display board or the signage or story board scenes. The display board thereby advantageously allows for rapid set-up and revision of signage and storyboards in studio, on location, or in the field, without having to acquire and prepare new board materials. A display board according to the invention designed from durable material such as magnetic sheet steel has an indefinite service life and may be reused innumerable times.

The frontal view of FIG. 3 also illustrates a hexagonal configuration that is achieved for each generally rectangular sheet 11 and 13 after forming the slanted corners 29. That is, the generally rectangular sheet 11 has six edges. Starting at the corner labeled 35 and reading clockwise, these edges are 21*c*, 29, 21*b*, 29, 21*a* and 23*a*. Furthermore, in this embodiment, a generally rectangular sheet 11 or 13 comprises a hexagon having edges consisting of at least four different lengths. The edges labeled 21*a* and 21*c* define a first length. The edges labeled 29 define a second length. The edge labeled 21*b* defines a third length. The edge labeled 23*a* defines a fourth length. In another embodiment, edge 21*b* has a length equal to either edge 21*a* or 21*c*, thereby defining a generally rectangular sheet comprising a hexagon having edges consisting of three different lengths.

Figure 4:
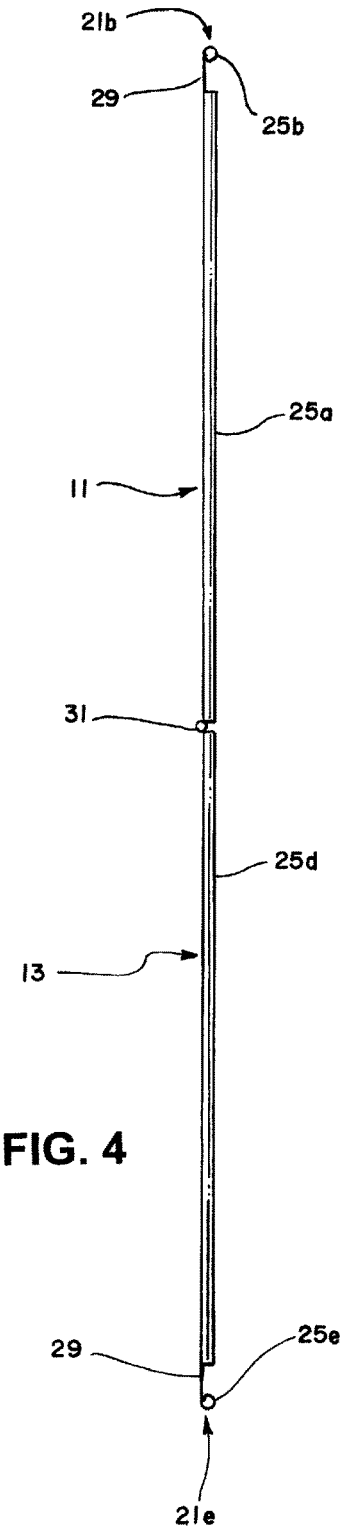
FIG. 4 is a right side view of the hinged portable display board of FIG. 1.
Figure 5:
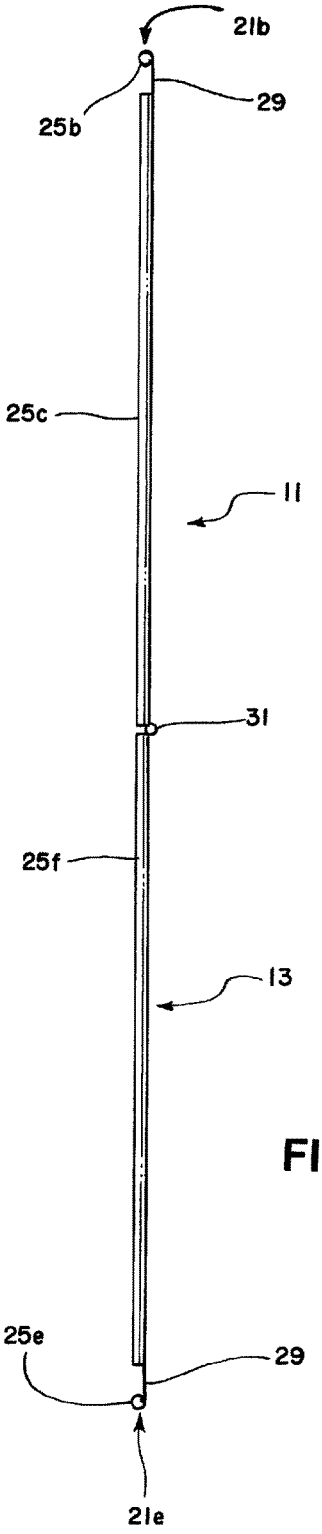
FIG. 5 is a left side view of the hinged portable display board of FIG. 1.

FIG. 4 shows a right side view of the hinged portable display board 10 and FIG. 5 shows a left side view of the hinged portable display board 10. Hinge pin 31 of the hinge 15 is visible in these views, separating the generally rectangular sheet 11 from the generally rectangular sheet 13. This view also illustrates the vertical displacement provided at slanted corners 29 between vertical duct 25*a* and horizontal duct 25*b*, between vertical duct 25*c* and horizontal duct 25*b*, between vertical duct 25*d* and horizontal duct 25*e*, and between vertical duct 25*f* and horizontal duct 25*e*.

Figure 6:
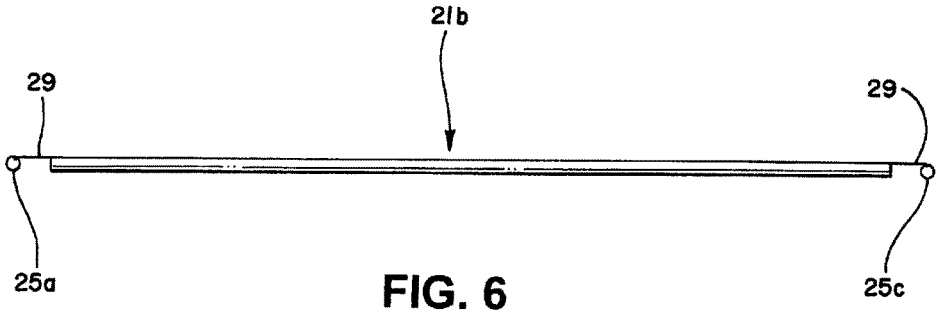
FIG. 6 is a top view of the hinged portable display board of FIG. 1.
Figure 7:
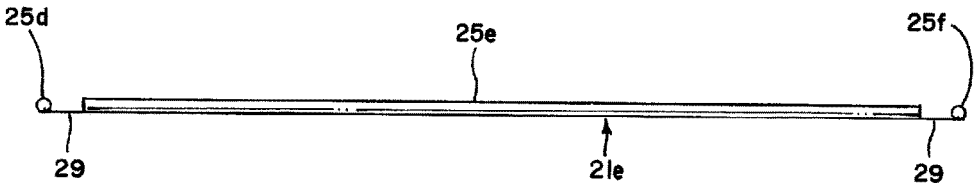
FIG. 7 is a bottom view of the hinged portable display board of FIG. 1.

FIG. 6 shows a top view of the hinged portable display board 10 and FIG. 7 shows a bottom view of the hinged portable display board 10. This view illustrates the horizontal displacement provided at slanted corners 29 between vertical duct 25*a* and horizontal duct 25*b*, between vertical duct 25*c* and horizontal duct 25*b*, between vertical duct 25*d* and horizontal duct 25*e*, and between vertical duct 25*f* and horizontal duct 25*e*. The general appearance of the views illustrated in FIGS. 6 and 7 also serve to depict top, bottom, right side, and left side views that hold for a hingeless embodiment of a display board 40 shown for example in FIG. 10 and further described below.

FIG. 8 shows a perspective view of the hinged portable display board 10 in a fully closed position. Here, the first generally rectangular sheet 11 has been rotated about the hinge axis to abut the second generally rectangular sheet 13, that is, to achieve an angle of approximately 0 degrees with respect to the second rectangular sheet 13. In other words, in the fully closed position, the opposite side of display area 17 (i.e. display area 37) abuts the opposite side of display area 19 (i.e. display area 39). In the fully closed position, the display board 10 may be more easily carried by hand, stowed away, or placed inside a carrying case.

FIG. 9 shows a magnified perspective view of a slanted corner 29 of a portable display board according to the invention. This view illustrates how a slanted corner of sufficient length displaces, horizontally and vertically, an open end of a horizontal duct from an open end of a vertical duct to allow passage of a rod along a longitudinal axis 33 of the horizontal duct without interference from the vertical duct and vice versa. It should be understood that the longitudinal axis of any of the ducts is an imaginary line running lengthwise through the geometric center of the duct when viewed in cross-section, and that the path of the axis continues indefinitely beyond the open ends of the duct. Although ducts 21*a* and 21*b* are depicted here, the general configuration of the slanted corner 29 that is shown in this figure may pertain to any slanted corner of the display board. Slanted corner 29 is depicted in this and other figures as forming an angle of approximately ±45 degrees or ±135 degrees with respect to any of the rod mountable edges 21*a* or 21*b*. It should be recognized, however, that angles other than these may be selected when configuring the slanted corner 29, so long as the configuration ensures that no duct interferes with rod passage through an axis of any other duct. In some embodiments, the slanted corners on two or more of the generally rectangular sheets need not be similarly configured.

The magnified view of FIG. 9 also illustrates the concept of adjacency as used herein. On a generally rectangular sheet 11 or 13, any two edges (e.g. 21*a*, 21*b*, 21*c*, 21*d*, 21*e*, 21*f*, 23*a*, or 23*b*) are adjacent edges if they are joined by a slanted corner 29. Rod mountable edges 21*a* and 21*b* are thus adjacent edges. Two edges are also adjacent if they join together at a conventional corner 35, as shown in FIG. 3. For example, rod mountable edge 21*c* is adjacent to hinged edge 23*a*, rod mountable edge 21*f* is adjacent to hinged edge 23*b*, etc. Conversely, any two edges that are not joined by a slanted corner 29, or that do not join together at a conventional corner 35 are nonadjacent edges. For example, rod mountable edge 21*b* and hinged edge 23*a* are nonadjacent edges.

Figure 10:
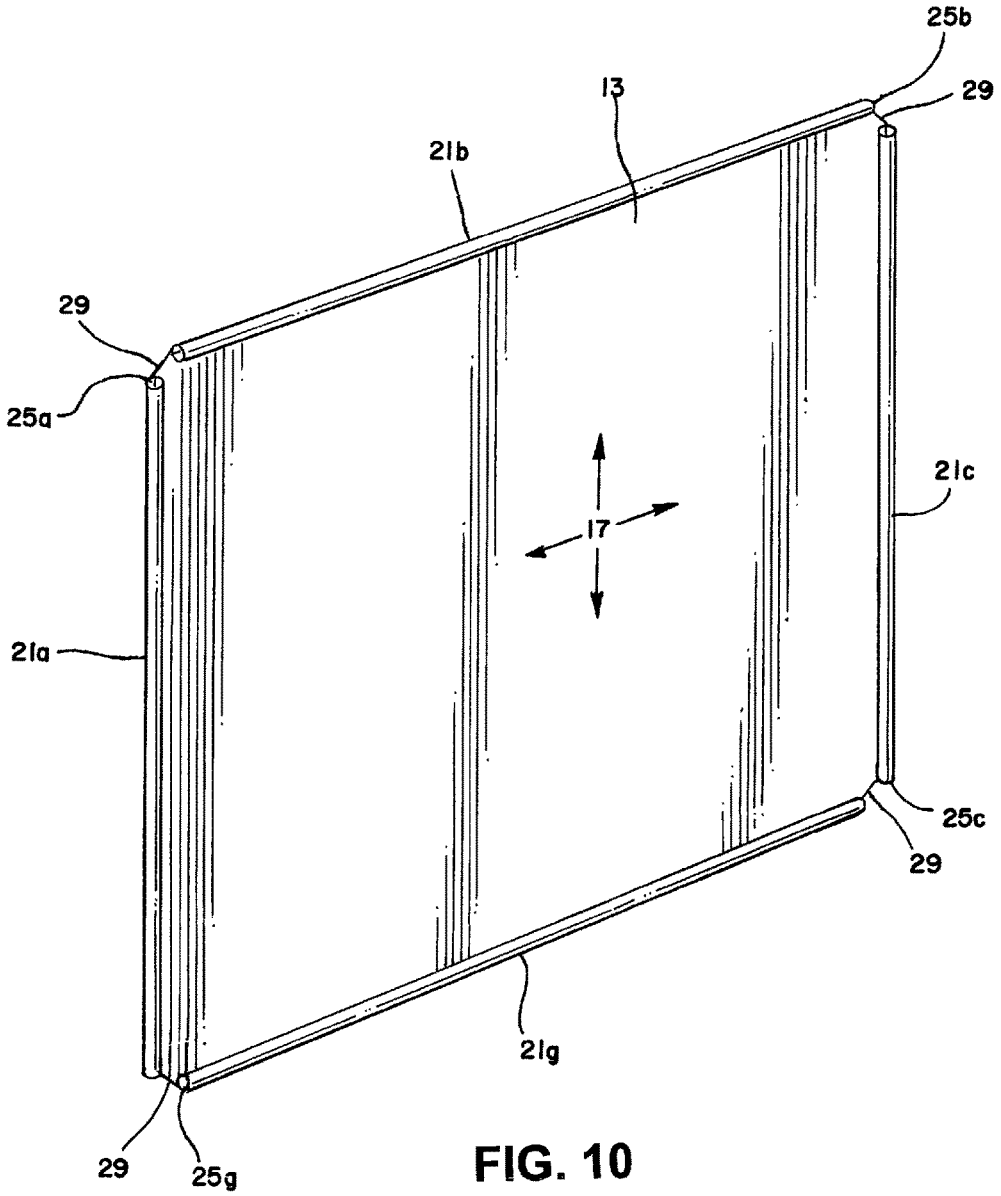
FIG. 10 is a perspective view of an embodiment of a hingeless portable display board according to the invention.

FIG. 10 is a rear perspective view of another embodiment of a portable display board 40 according to the invention. Display board 40 is shown in rear perspective view to better illustrate its characteristic features. Display board 40 is a hingeless display board, having a generally rectangular form wherein all four edges 21*a*, 21*b*, 21*c*, and 21*g* are rod mountable edges that border a generally rectangular sheet 13 to form a display area 17. But for the absence of a hinged edge, display board 40 is, in every other respect, similar in form and function to display board 10 described above. Display board 40 includes ducts 25*a*, 25*b*, 25*c*, and 25*g*, joined at their open ends by slanted corners 29 as shown.

The view of FIG. 10 also illustrates an octagonal configuration that is achieved for the generally rectangular sheet 13 after forming the slanted corners 29. That is, the generally rectangular sheet 13 has eight edges. Starting at the bottom left slanted corner and reading clockwise, these edges are 29, 21*a*, 29, 21*b*, 29, 21*c*, 29, and 21*g*. Furthermore, in this embodiment, a generally rectangular sheet 13 comprises an octagon having edges consisting of at least three different lengths. The edges labeled 21*a* and 21*c* define a first length. The edges labeled 29 define a second length. The edges labeled 21*b* and 21*g* define a third length. In another embodiment, edges 21*b* and 21*g* each have a length equal to either edge 21*a* or 21*c*, thereby defining a generally rectangular sheet comprising an octagon having edges consisting of two different lengths.

Figure 11:
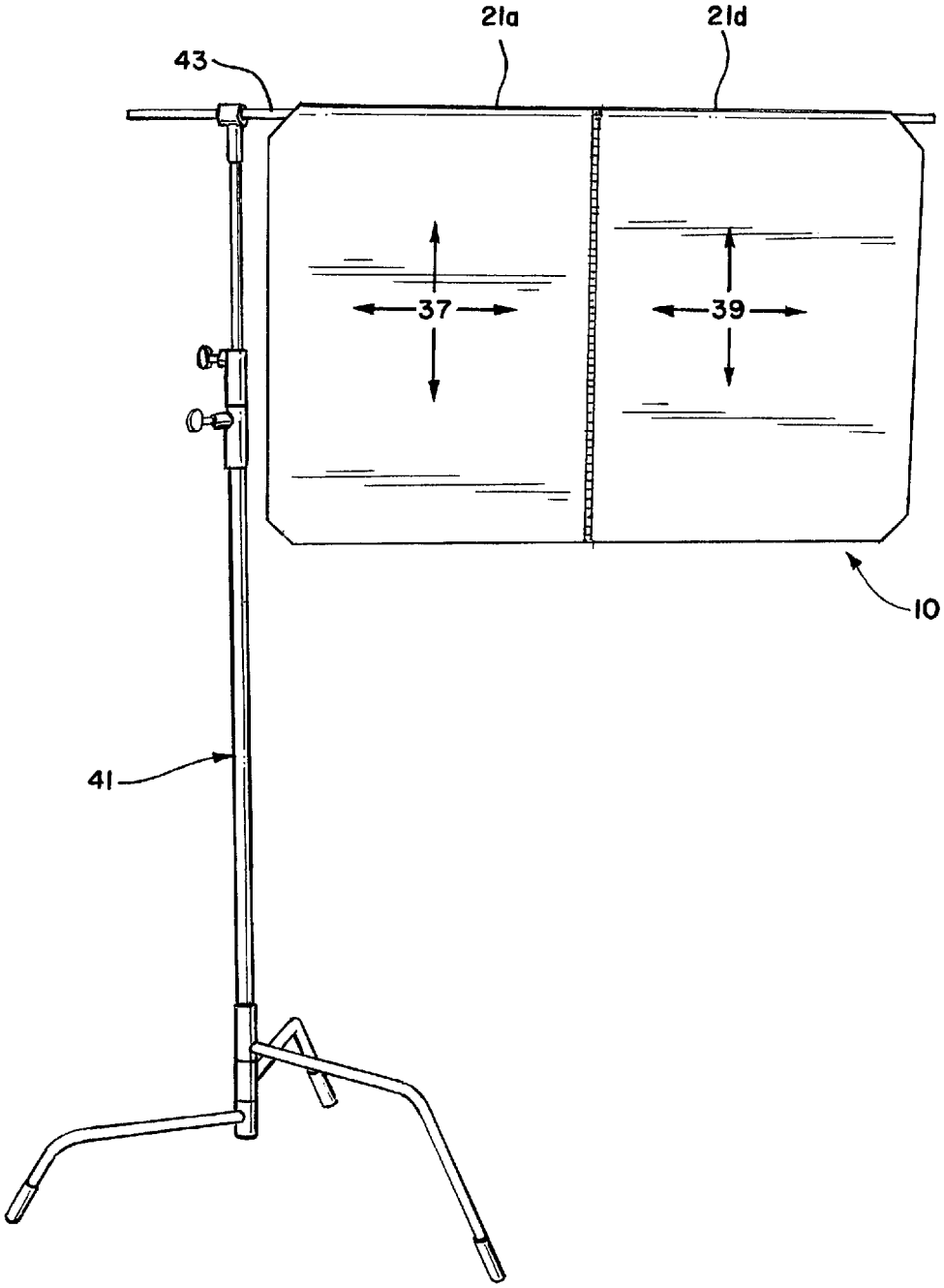
FIG. 11 is a perspective view of an embodiment of a portable display board in a state of use according to the invention wherein the portable display board is suspended by a duct from a C-stand.

FIG. 11 shows a perspective view of an embodiment of a portable display board in a state of preferred usage according to the invention. This view shows the display board 10 suspended from a typical C-stand 41, such as those commonly used in the motion picture industry for mounting lights for illuminating a set or scene. In this example, a portable display board 10 is oriented to allow the mounting rod 43 of the C-stand 41 to pass through the ducts of both rod mountable edges 21*a* and 21*d* so that display areas 37 and 39 are suspended side-by-side, as shown. The present invention thereby enhances the utility of the ubiquitous C-stand, exploiting its form, function, and availability for use in supporting a portable display board that can serve as a storyboard.

The size and capacity ratings of the C-stand provide a design basis for a preferred embodiment of a display board 10 or 40. The mounting rod 43 of the C-stand 41 is a component of particular interest, as it provides a means for mounting or suspending the portable display board in the preferred state of use. A standard size for the mounting rod 43 is ⅝-inch diameter; however, C-stands are available in many different configurations and lengths. A typical load rating for many C-stands is about 22-lb. Thus, a particular embodiment of the display board should be designed with its mounting means in mind, for example, to ensure that the duct 25 has sufficient size (e.g. slightly greater than ⅝-inch diameter) to allow for passage of the mounting rod 43, and to ensure that the overall height and weight of the display board do not exceed the capacity of the C-stand. Aside from these concerns, the structure and operation of a typical C-stand are well known and need not be further described herein.

Figure 12:
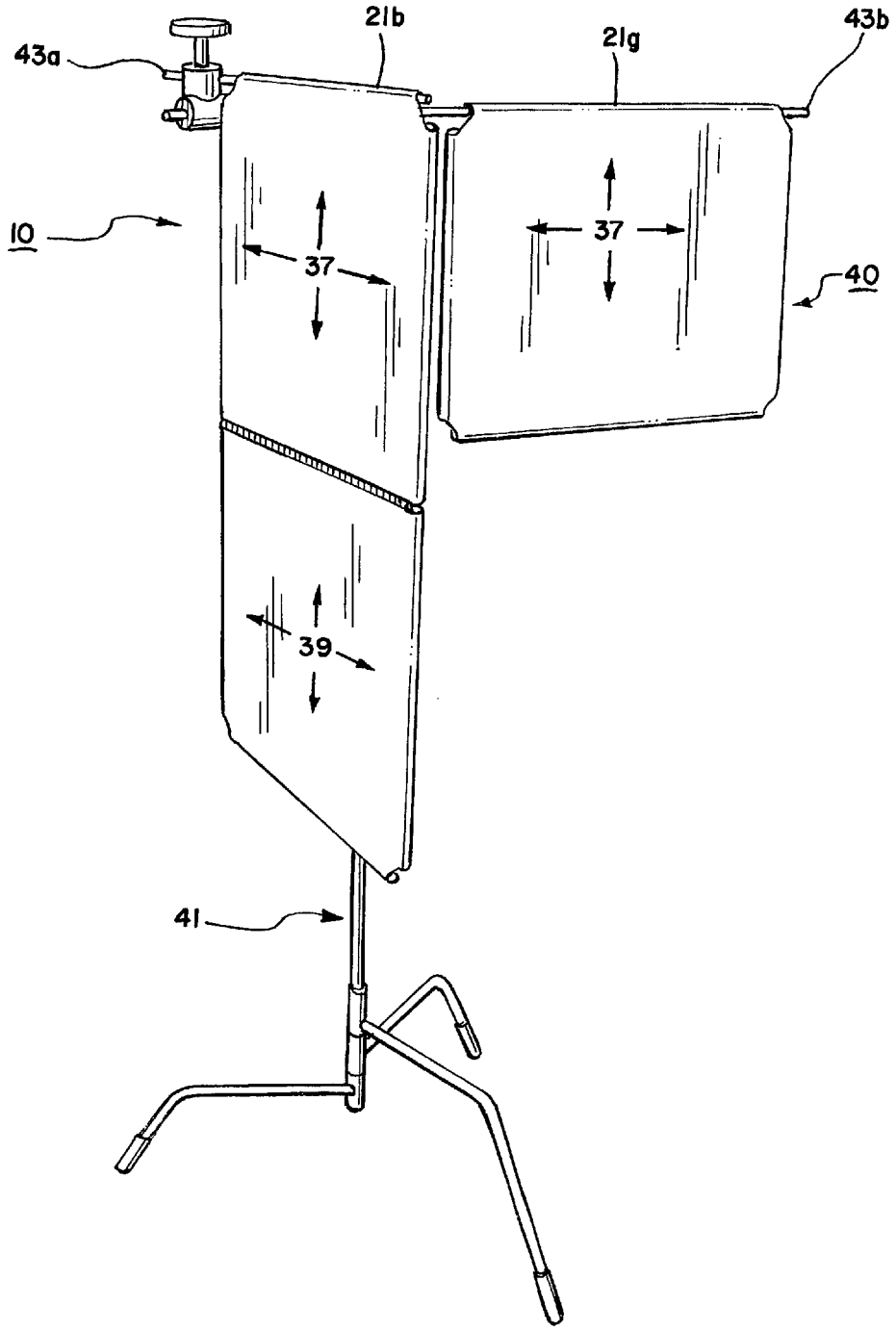
FIG. 12 is a perspective view of both hinged and unhinged embodiments of a portable display board according to the invention in states of use wherein each display board is suspended by a duct from a C-stand.

FIG. 12 shows a perspective view of both hinged and unhinged embodiments according to the invention of portable display boards 10 and 40 in a preferred state of use. Here again, each portable display board is shown suspended from the mounting rod of a C-stand by the duct of a rod mountable edge. Note that this particular C-stand 41 has been equipped with multiple mounting rods 43*a* and 43*b*. Portable display board 10 has been oriented to allow the mounting rod 43*a* of the C-stand 41 to pass only through the duct of rod mountable edge 21*b* so that display area 37 is suspended above display area 39. Mounting rod 43*b*, which is shown extending away from mounting rod 43*a* at a right angle, passes only through the duct of rod mountable edge 21*g* of portable display board 40. This figure illustrates a convenience realized by the symmetrical designs of the portable display boards, which may allow the board to be suspended from any one of its ducts. Thus, terms such as horizontal, vertical, top, bottom, upper, lower, right side, and left side are provided herein as relative terms only, and not as absolute terms, to define right-angle and spatial relationships and to otherwise aid the reader in understanding the invention with specific reference to the drawings. A user wishing to deploy the display board may simply by raise it by hand to a mounting rod and slide one of the ducts onto the rod without giving a second thought to which end is up or down.

Figure 13:
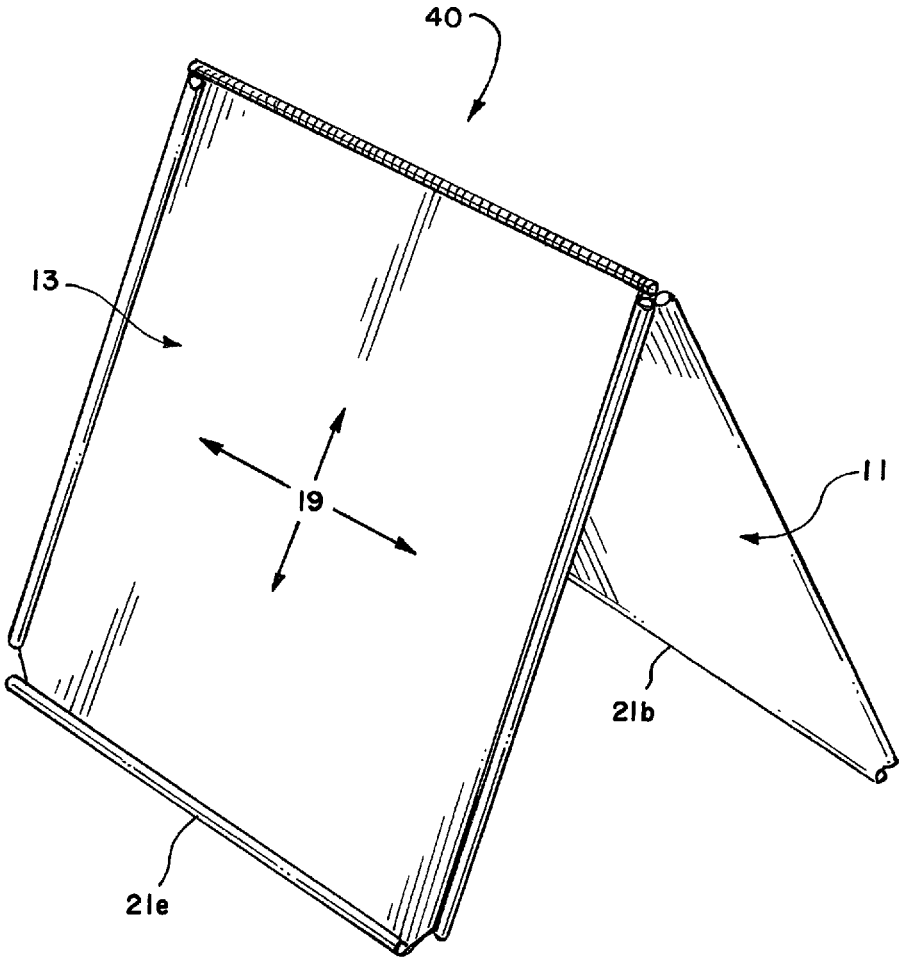
FIG. 13 is a perspective view of an embodiment of a hinged portable display board in a state of use according to the invention wherein the rod mountable edges of the portable display board are partially separated for ground mounting in a bipod position to place the display areas at a viewable angle.

FIG. 13 shows a perspective view of an embodiment of a hinged portable display board 40 in another state of use according to the invention. In this state of use, the rod mountable edges 21*b* and 21*e* of the portable display board 10 are partially separated for ground mounting in a bipod position to place the display areas 17 and 19 at an angle viewable to a passerby. This view shows the display board 40 rotated so that the generally rectangular sheet 13 forms an angle of approximately 60 degrees with respect to the generally rectangular sheet 11. This usage is well-suited for temporary signage applications, such as advertising by storefronts, for advertising real estate or yard sales, for directing traffic at conventions or on roadways, for providing markers for athletic events, or for warning pedestrians and other travelers of road hazards, etc. The hinged portable display board can thus serve its intended function without being suspended from a mounting rod. Rod mountable edges having sharp corners or flat surfaces, such as those formed by square or triangular ducts, may be better suited than cylindrical ducts for this state of use. Non-cylindrical ducts such as these could provide greater stability for the display board through greater contact area between the rod mountable edges and ground.

In addition to the aforementioned mounting arrangements, it should be appreciated that other means for mounting portable display boards that require slight modification to the schemes presented herein are possible within the scope of the invention. For example, one or more of the horizontal or vertical ducts may be configured for mounting the portable display board to a wall by drilling one or more mounting holes 26 at desired locations along one or more ducts. The display board could then be temporarily mounted to the wall by suspending it from mounting bolts or other hardware.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A portable display board, comprising:

a first generally rectangular sheet defining a first display area bordered by a first hinged edge and having at least one rolled, rigid rod mountable edge at a perimeter of the display board; and a second generally rectangular sheet defining a second display area bordered by a second hinged edge and having at least one other rolled, rigid rod mountable edge at the perimeter of the display board;

a hinge rotatably connecting the first generally rectangular sheet to the second generally rectangular sheet, the hinge comprising the first hinged edge and the second hinged edge;

each of the rolled, rigid rod mountable edges comprising a duct configured for passage of a mounting rod therethrough; and each of the sheets having at least one slanted corner nonadjacent to its hinged edge.

2. The portable display board of claim 1 wherein the first generally rectangular sheet is composed of magnetic material.

3. The portable display board of claim 1 wherein the duct of the at least one rolled, rigid rod mountable edge of the first generally rectangular sheet is generally cylindrical.

4. The portable display board of claim 1 wherein the duct defines a gap between an edge of the duct and a surface of the display area, the gap extending longitudinally between open ends of the duct.

5. The portable display board of claim 1 wherein the duct of the at least one rod mountable edge of the first generally rectangular sheet runs along substantially an entire length of the rod mountable edge.

6. The portable display board of claim 1 wherein the first generally rectangular sheet and the second generally rectangular sheet are of identical design.

7. The portable display board of claim 1 wherein the first generally rectangular sheet comprises:

a horizontal rolled, rigid rod mountable edge comprising a horizontal duct having an open right end and an open left end; and a vertical rolled, rigid rod mountable edge comprising a vertical duct having an open top end and an open bottom end, the open top end adjacent to the open right end or to the open left end, and the open bottom end adjacent to the first hinged edge.

8. The portable display board of claim 7 configured so that the at least one slanted corner horizontally and vertically displaces the open right end or the open left end of the horizontal duct from the open top end of the vertical duct to allow passage of the rod along a longitudinal axis of the horizontal duct without interference from the vertical duct.

9. The portable display board of claim 1 wherein the first generally rectangular sheet comprises two slanted corners and of at least three different lengths.

10. The portable display board of claim 1 wherein the duct is formed from the first generally rectangular sheet.

11. The portable display board of claim 10 wherein the duct is formed by rolling an edge of the first generally rectangular sheet to form the at least one rod mountable edge of the first generally rectangular sheet.

12. The portable display board of claim 1 wherein the at least one rolled, rigid rod mountable edge of the first generally rectangular sheet comprises first and second rolled, rigid rod mountable edges, wherein the duct for each of the first and second rolled, rigid rod mountable edges is formed by rolling an edge of the first generally rectangular sheet, and wherein the duct of the first rolled, rigid rod mountable edge and the duct of the second rolled, rigid rod mountable edge are rolled over a common side of the first generally rectangular sheet.

13. The portable display board of claim 1 further comprising a non-reflective coating covering the first display area.

* * * * *